US006528457B2

(12) United States Patent
Howell et al.

(10) Patent No.: US 6,528,457 B2
(45) Date of Patent: Mar. 4, 2003

(54) COMPOSITION COMPRISING HALOGENATED OIL

(75) Inventors: Jon L. Howell, Bear, DE (US); H. Carl Walther, Landenberg, PA (US); Gregory A. Bell, New Castle, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/894,112

(22) Filed: Jun. 28, 2001

(65) Prior Publication Data

US 2003/0013617 A1 Jan. 16, 2003

(51) Int. Cl.[7] ..... C10M 105/54; C10M 105/76; C10M 169/02

(52) U.S. Cl. ..... 508/180; 508/136; 508/148; 508/155; 508/165; 508/181; 508/182; 508/183; 508/206; 508/208; 508/421; 508/435; 508/464; 508/527; 508/552; 508/582

(58) Field of Search ..... 508/582, 590, 508/206, 180

(56) References Cited

U.S. PATENT DOCUMENTS 3,006,847 A * 10/1961 Wiley et al. ..... 508/180
3,639,237 A * 2/1972 Curtis ..... 508/138
4,925,583 A * 5/1990 Juhlke et al. ..... 252/58
5,032,302 A * 7/1991 Juhlke et al. ..... 252/54
5,124,058 A * 6/1992 Corti et al. ..... 252/54
5,154,845 A * 10/1992 Williams ..... 252/54
5,307,660 A * 5/1994 Stoutenburg ..... 72/42
5,385,682 A * 1/1995 Hutchings et al. ..... 508/178
5,385,686 A 1/1995 Miller et al.
5,494,596 A * 2/1996 Law et al. ..... 252/54
5,851,635 A * 12/1998 DiGiacomo et al. ..... 428/167
6,040,277 A * 3/2000 Caporiccio ..... 508/155
6,127,320 A * 10/2000 van Ooij et al. ..... 508/138
6,268,321 B1 * 7/2001 Sprague ..... 508/590
6,329,326 B1 * 12/2001 Iso et al. ..... 508/182

* cited by examiner

*Primary Examiner*—Ellen M. McAvoy

(57) ABSTRACT

A composition that can be used as lubricant for high electric field including spark plug boots is disclosed. The composition comprises, or is produced by combining, a halogenated oil such as a perfluoropolyether, a polytrichlorofluoroethylene, a fluorosilicone, or combinations of two or more thereof; a basic thickener; and optionally an additional thickener in which the basic thickener is a metal hydroxide, a metal salt, an ammonium salt, or combinations of two or more thereof. The optional additional thickener is polytetrafluoroethylene, talc, silica, clay, boron nitride, metal soaps, titanium dioxide, polydimethylsiloxane, polyurea, polyurethane, or combinations of two or more thereof. Also provided is a spark plug boot that comprises the composition applied thereto.

18 Claims, No Drawings

COMPOSITION COMPRISING HALOGENATED OIL

FIELD OF THE INVENTION

The invention relates to a composition, which comprises a halogenated oil and a basic thickener and can be used as a lubricant in the presence of strong electric field and high voltage applications.

BACKGROUND OF THE INVENTION

A spark plug boot is the cover over the high voltage terminal and is typically made of a silicone rubber. A lubricant is used to aid placement of the boot and to prevent the boot from sticking to the plug. Presently KRYTOX GPL205 (a grease containing KRYTOX GPL 105 perfluoropolyether oil thickened only with polytetrafluoroethylene) is used to fill the small internal space between the boot and the plug to provide this lubrication. Likewise, similar products are marketed for the same application. Trademarks herein are denoted by upper case names.

Under severe environment, the boot and grease are subject to a high voltage corona discharge. When hydrocarbon or silicone lubricants are used, the silicone rubber boot tends to adhere to the ceramic insulator of the plug.

A variety of types of physical barriers have been used as release agents in the spark plug-to-spark plug boot interface in automotive applications to improve the dielectric capability of the interface and to prevent the spark plug and spark plug boot from bonding to each other. However, such techniques do not meet desired characteristics for a superior release agent.

Heretofore, greases and powders have been put in the boots, and fluorotelomer coatings have been put on spark plugs. U.S. Pat. No. 5,385,686 (hereinafter referred to as "Miller et al" and incorporated herein by reference), which contains a section diagram of the spark plug and boot assembly, discloses use of boot lubricant grease consisting of a PTFE (polytetrafluoroethylene)-based oil and a poly (dimethylsiloxane) extender.

The desired characteristics of a superior release agent, as disclosed in Miller et al, are to (1) provide excellent dielectric capability, (2) prevent spark plug-to-spark plug boot bonding, (3) sustain acceptable engage/disengage forces for the interface, (4) insure no detrimental physical or chemical effects on the interface components, (5) remain operable after elevated temperatures and environmental exposures, (6) process easily and readily, (7) be cost effective; and (8) protect the spark-plug-boot from perfluoropolyether corona discharge products.

The above-described spark plug boot greases do not meet the desired characteristics for one reason or another. Some greases tend to dry up and even fall out of the interface over a period of time resulting in poor dielectric and mechanical properties. Powders often have undesired mechanical properties. Plug coatings, such as fluorotelomer, are usually much too expensive to be commercially utilized in automotive applications. Standard perfluoropolyether (PFPE) greases or admixtures of PFPE greases with silicones cannot protect the spark plug boot from corona discharges found in the current boot environment. Splitting of the boots due to the corona-induced decomposition of PFPEs has been observed in testing and the industry.

Therefore, there is a need to develop a lubricant that can overcome the shortcomings disclosed above.

SUMMARY OF THE INVENTION

According to a first embodiment, there is provided a composition that comprises, consists essentially of, consists of, or is produced by combining, a halogenated oil, a basic thickener, and optionally an additional thickener in which the basic thickener is a metal hydroxide, a metal salt, an ammonium salt, or combinations of two or more thereof.

According to a second embodiment, there is provided a spark plug boot that comprises a composition applied thereto in which the composition can be the same as that disclosed above in the first embodiment of the invention.

DETAILED DESCRIPTION OF THE INVENTION

The term "halogenated oil" used herein referred to a perfluoropolyether, a fluorosilicone, a polytrifluorochloroethylene, or combinations of two or more thereof.

Any perfluoropolyether, known to one skilled in the art can be used in the invention composition. A common characteristic of perfluoropolyethers is the presence of perfluoroalkyl ether moieties. The term "perfluoropolyether" is exchangeable with "PFPE", "PFPE oil", "PFPE fluid", "PFPAE", or "perfluoropolyalkylether", as is known to one skilled in the art.

For example, KRYTOX available from E. I. du Pont de Nemours and Company, Wilmington, Delaware is a perfluoropolyether having the formula of $CF_3—(CF_2)_2—O—[CF(CF_3)—CF_2—O)_s—R_f$. In the formula, s is 2–100, inclusive and $R_f$ is $CF_2CF_3$, a $C_3$ to $C_6$ perfluoroalkyl group , or combinations thereof.

FOMBLIN and GALDEN fluids, available from Ausimont, Milan, Italy and produced by perfluoroolefin photooxidation, can also be used. FOMBLIN-Y can have the formula of $CF_3O(CF_2CF(CF_3)—O—)_m(CF_2—O—)_n—R^1_f$. Also suitable is $CF_3O[CF_2CF(CF_3)O]_m(CF_2CF_2O)_o(CF_2O)_n—R^1_f$. In the formulae $R^1_f$ is $CF_3$, $C_2F_5$, $C_3F_7$, or combinations of two or more thereof; (m+n) is 8–45, inclusive; and m/n is 20–1000, inclusive. o is>1; (m+n+o) is 8–45, inclusive;m/n is 20–1000, inclusive; $R^2_f$ is $CF_3$, $C_2F_5$, or combinations thereof; t is 2–200, inclusive; (p+q) is 40–180, inclusive; and p/q is 0.5–2, inclusive FOMBLIN-Z can have the formula of $CF_3O(CF_2CF_2—O—)_p(CF_2—O)_qCF_3$ where (p+q) is 40–180 and p/q is 0.5–2, inclusive.

DEMNUM fluids, available from Daiken Industries, Japan, can also be used. It can be produced by sequential oligomerization and fluorination of 2,2,3,3-tetrafluorooxetane, yielding the formula of $F—[(CF_2)_3—O]_t—R^2_f$ where $R^2_f$ is $CF_3$, $C_2F_5$, or combinations thereof and t is 2–200, inclusive.

Perfluoropolyethers comprising branched or straight chain perfluoroalkyl radical end groups, each of which having 3 or more carbon atoms per end group can also be used. Examples of such perfluoropolyethers can have the formula of $C_rF_{(2r+1)}—A—C_rF_{(2r+1)}$ in which each r is independently 3 to 6; A can be $O—(CF(CF_3)CF_2—O)_w$, $O—(CF_2—O)_x(CF_2CF_2—O)_y$, $O—(C_2F_4—O)_w$, $O—(C_2F_4—O)_x(C_3F_6—O)_y$, $O—(CF(CF_3)CF_2—O)_x(CF_2—O)_y$, $O—(CF_2CF_2CF_2—O)_w$, $O—(CF(CF_3)CF_2—O)_x(CF_2CF_2—O)_y—(CF_2—O)_z$, or combinations of two or more thereof; preferably A is $O—(CF(CF_3)CF_2—O)_w$, $O—(C_2F_4—O)_w$, $O—(C_2F_4—O)_x(C_3F_6—O)_y$, $O—(CF_2CF_2CF_2—O)_w$, or combinations of two or more thereof; w is 4 to 100; x and y are each independently 1 to 100. Specific examples include, but are not limited to, $F(CF(CF_3)—CF_2—O)_9—CF_2CF_3$, $F(CF(CF_3)—CF_2—O)_9—CF(CF_3)_2$, and combinations thereof. In such PFPEs, up to 30% of the halogen atoms can be halogens other than fluorine, such as, for example, chlorine atoms.

Fluorosilicones suitable for use in the invention can be any fluorocarbon containing silicone fluid. The preferred fluorosilicone is a fluorosilane, a fluorosiloxane, or combinations thereof. A suitable fluorosilicone can have the formula of $R_f(CH_2)_n—Si—R'_3$ in which $R_f$ and n are the same as those disclosed above and each R' can be independently an alkyl group, an alkoxy group, a thioalkyl group, an amino group, an aryl group, or combinations of two or more thereof. An example of suitable fluorosilicone is DOW CORNING FS-1265 fluorosilicone oil from Dow Corning, Midland, Mich.

Polytrifluorochloroethylenes suitable for use in the invention can have the formula of $(—CCl_2CFCl—)_s$ where s is a number of 2 to about 100. Example of suitable polytrifluorochloroethylenes are HALOCARBON oils from Halocarbon, Riveredge, N.J. The preferred polytrifluorochloroethylene is HALOCARBON 200.

The basic thickener is one or more metal hydroxides, ammonium salts, and basic metal salts. The preferred basic thickeners are ammonium salts, alkali metal salts, and alkaline earth metal salts such as, for example, carbonates, bicarbonates, phosphates, carboxylates, or nitrites. The term "phosphate" used herein refers to "phosphate", "metaphosphate", "pyrophosphate", or "polyphosphate". Most preferably the basic thickener is a basic alkali metal salt, such as sodium or potassium carbonate or trisodium phosphate.

The amount of the basic thickener used is an amount effective to produce a lubricant that can withstand the hostile environment under the operating condition of an automobile spark plug. Generally, the amount can be that which is sufficient to form a grease containing at least 0.1 gram equivalents of basic thickener cation per 100 g of the composition of the invention, preferably at least 0.26 gram equivalents of the basic thickener cation per 100 g of the composition of the invention, and most preferably at least 0.5 gram equivalents. For example, 0.26 gram equivalents correspond to about 6% sodium, at least about 10% potassium, or at least about 5% calcium, etc., all by weight. The upper limit for the amount of basic thickener in the halogenated oil is determined by National Lubricating Grease Institute (NLGI) Grade specification required.

The optional additional thickeners include, but are not limited to, PTFE (polytetrafluoroethylene), talc, silica, clay, boron nitride, metal soaps, titanium dioxide, polydimethylsiloxane, polyurea, polyurethane, or combinations of two or more thereof. These are well known to one skilled in the art and are commercially available.

The optional additional thickeners, if desired, in the halogenated oil are subject to the requirement that the grease meets Grade 000 to Grade 4 specifications, and preferably to Grade 2 specifications. Greases are graded according to NLGI. All components can be mixed together in a manner well known to those skilled in the art.

The invention composition can be produced by any means known to one skilled in the art such as, for example, mixing the composition together. Because the means are well known, the discussion is omitted herein in the interest of brevity.

The present invention is further directed to the use of the invention compositions as a spark plug boot lubricant.

According to the second embodiment of the invention, a spark plug boot having a composition applied thereto is provided. The spark plug can be any spark plug such as an automotive spark plug. A spark plug is disclosed in Miller et al, disclosure of which is incorporated herein by reference.

The composition can be the same as the composition disclosed in the first embodiment of the invention.

Generally, the composition can be applied on to the wall or a portion thereof that forms the boot cavity and preferably near the end of the boot. The application can be carried out by any means known to one skilled in the art such as spraying, wiping, etc.

For example, the composition of the present invention can be placed on a portion of the walls forming the spark plug boot cavity as described by Miller et al (as described above) and preferably near the open end of the boot. As an example of the present invention, a lubricant can contain 67% by weight of a perfluoroalkylpolyether oil such as KRYTOX GPL105, one of the family of KRYTOX GPL (General Purpose Lubricants which also includes GPL 107-500) and 37% anhydrous sodium carbonate. KRYTOX oils and greases are available from E. I. du Pont de Nemours and Company. Finely divided or micropowder forms of PTFE (also available from E. I. du Pont de Nemours and Company), talc, silica, or other additional thickener disclosed above, if desired, can also be included in the grease composition in amounts such that the desired grease consistency is obtained. Sodium carbonate can be replaced with any of the salts listed above.

While not wishing to be bound by theory, it is believed that the basic thickeners of the present invention provide a means to remove fluorine-containing degradation products, such as hydrofluoric acid, formed by high voltage discharge during use. Such reactive decomposition products are believed to degrade the boot and cause unwanted adhesions and cracking in the boot assembly, complicating maintenance. Thus it can be readily understood that greases containing less basic thickener provide progressively less protection.

The following examples are provided to illustrate, but are not to be construed to unduly limit the scope of, the present invention.

TEST METHOD

Spark Plug Boot Cracking Resistance Test

For each trial, 4 Spark plugs and lubricated boots were assembled and 15k V RMS at 50–60 Hz applied while the assembly was maintained in an oven at 175° C. Each boot was lubricated with a nominal 0.10 g of grease. One boot was removed at 96 hours and the rest were removed after 144 hours of continuous testing. The boots were then dissected and evaluated.

The tested boot was evaluated on a scale of 0 (best) to 5 (worst) with the evaluation criteria shown in Table 1. Each grease sample was evaluated with three boots and the ratings were averaged. An evaluation of 3.7 or lower is required, preferably 2.5 or lower after the 144 hours exposure.

TABLE 1

| Evaluation Criteria | |
|---|---|
| Rating 0 | No crazing or cracking, as in an untested boot. |
| Rating 1 | Heavy surface crazing but relatively very minor shallow cracks in the upper portion of the tower seal. Level of crazing/cracking is very minor and not considered to be a significant opportunity for failure. |
| Rating 2 | Moderate amount of relative shallow cracking just above the tower seal area. |
| Rating 3 | Moderate amount of deep cracking in upper portion of tower seal; very small shallow cracks throughout the tower seal; |

TABLE 1-continued

| Evaluation Criteria | |
|---|---|
| | a few large cracks at the extreme end of the boot tower seal. |
| Rating 4 | Heavy to severe deep cracking in the upper portion of the tower seal and very small shallow cracks throughout the tower seal area. |
| Rating 5 | Severe deep cracking in upper portion of tower seal and significant amount of medium depth cracks throughout tower seal, some cracks/splits at bottom of tower seal (end of boot). |

EXAMPLES

Greases were prepared by conventional methods well known to those skilled in the art of grease making. Basically, with excellent mixing, one added thickener to a halogenated oil until the desired NLGI Grade of hardness was obtained (in this case grade 2). Different thickeners and additives were incorporated into the test greases, as shown in the key. The normal practice was to prepare a grease for which the penetration was adjusted by additions of either oil or thickener and mixing using a 3-roll mill with a 0.0010 inch (0.00254 cm) gap until the final result is an NLGI #2 grease. Compositions were described in weight percent.

Example 1

A NLGI Grade 2 grease was prepared by the conventional method described above from KRYTOX GPL105 (67%) using anhydrous sodium carbonate ($Na_2CO_3$, 33%, EM Science Brand from VWR, Gibbstown N.J.) as thickener.

Examples 2–7 and Comparative Examples A–C

The following Examples and Comparative Examples were prepared as in Example 1, using sodium carbonate, potassium carbonate, trisodium phosphate, IGACOR DSSG (disodium sebacate from Ciba Specialty Chemicals, Tarrytown, N.Y.), and PTFE (any micropowder of medium size 15 mm or such as those available from E.I. du Pont de Nemours and Company) as shown in Table 2.

TABLE 2

Grease Compositions.

| Ex. # | PFPE Oil (%) | Thickener(s) (%) | Penetration* |
|---|---|---|---|
| | | Examples | |
| 1 | KRYTOX GPL105 (67) | $Na_2CO_3$ (33) | 287 |
| 2 | KRYTOX GPL105 (74.6) | $K_2CO_3$ (25.4) | 268 |
| 3 | KRYTOX GPL105 (56) | $Na_3PO_4$ (44.0) | 290 |
| 4 | KRYTOX GPL105 (67) | $Na_2CO_3$ (16.5), PTFE (16.5) | 279 |
| 5 | KRYTOX GPL105 (69) | $Na_2CO_3$ (7.75), PTFE (23.25) | 275 |
| 6 | KRYTOX GPL107-500 (78.7) | IGACOR DSSG (21.3) | 287 |
| 7 | KRYTOX GPL105 (76.9) | IGACOR DSSG (23.1) | 272 |
| | | Comparative Examples | |
| A | KRYTOX GPL105 (75) | PTFE (25) | 287 |
| B | KRYTOX GPL107-500 (78.5) | PTFE (21.5) | 290 |
| C | KRYTOX GPL105 (75) | PTFE (20), IGACOR DSSG (5) | 287 |

*Penetration units are $m^{-4}$. NLGI Grade 2 specifications require a penetration range of 265–290 $m^{-4}$ (26.5–29 $\mu$m).

Test results using the Spark Plug Boot Cracking Resistance Test are shown in Table 3.

TABLE 3

Cracking Test Data

| Ex. # | 96 Hour Individual Rating | 144 Hour Individual Ratings | 144 Hour Rating Average | Cation g equivalent/ 100 g Grease |
|---|---|---|---|---|
| | | Examples | | |
| 1 (Trial 1) | 1 | 1, 1, 1 | 1 | 0.62 |
| 1 (Trial 2) | 2.3 | 2, 2.3, 2.3 | 2.2 | 0.62 |
| 2 | 1 | 1, 3, 3 | 2.3 | 0.62 |
| 3 | 2.3 | 2, 2, 3.3 | 2.43 | 0.80 |
| 4 | 1 | 1, 1.5 | 1.2 | 0.31 |
| 5 | 2 | 2.3, 2.3, 2.6 | 2.4 | 0.15 |
| 6 | 3.6 | 3.6, 3.6 | 3.6 | 0.19 |
| 7 | 2.3 | 3.6, 3.6, 3.6 | 3.6 | 0.17 |
| | | Comparative Examples | | |
| A (Trial 1) | 3.8 | 4, 4, 4 | 4 | 0 |
| A (Trial 2) | 4 | 4, 4, 4 | 4 | 0 |
| B | 3.8 | 4, 4, 4 | 4 | 0 |
| C | 4 | 4, 5, 4 | 4.3 | 0.04 |

As can be seen in the above Tables, the lubricant of the present invention, utilizing a combination of perfluoroalkylpolyether and alkali metal salt in a grease, greatly reduces spark-plug-boot cracking during severe service.

What is claimed is:

1. A composition comprising or produced by combining a halogenated oil, a basic thickener, and optionally an additional thickener wherein said halogenated oil is a perfluoropolyether, a fluorosilicone, or combinations thereof and said basic thickener is a metal hydroxide; a metal salt which is a metal carbonate, a metal bicarbonate, a metal phosphate, or a metal nitrite; an ammonium salt; or combinations of two or more thereof.

2. A composition according to claim 1 wherein said halogenated oil is said perfluoropolyether and is $CF_3—(CF_2)_2—O—[CF(CF_3)—CF_2—O]_s—R_f$, $CF_3O[CF_2CF(CF_3)—O—]_m(CF_2—O—)_n—R^1_f$, $F—[(CF_2)_3—O]_t—R^2_f$, $CF_3O(CF_2CF_2—O—)_p(CF_2—O)_qCF_3$, $CF_3O[CF_2CF(CF_3)O]_m(CF_2CF_2O)_o(CF_2O)_n—R^1_f$, or combinations of two or more thereof; s is 2–100, inclusive; $R_f$ is $CF_2CF_3$, a $C_3$ to $C_6$ perfluoroalkyl group, or combinations thereof; $R^1_f$ is $CF_3$, $C_2F_5$, $C_3F_7$, or combinations of two or more thereof; (m+n) is 8–45, inclusive; (m+n+o) is 8–45, inclusive; m/n is 20–1000, inclusive; o is >1; $R^2_f$ is $CF_3$, $C_2F_5$, or combinations thereof; t is 2–200, inclusive; (p+q) is 40–180, inclusive; and p/q is 0.5–2, inclusive.

3. A composition according to claim 2 wherein said perfluoropolyether is $CF_3—(CF_2)_2—O—[CF(CF_3)—CF_2—O]_s—R_f$.

4. A composition according to claim 1 wherein said basic thickener is an ammonium salt, an alkali metal salt, an alkaline earth metal salt, or combinations of two or more thereof.

5. A composition according to claim 2 wherein said basic thickener is an ammonium salt, an alkali metal salt, an alkaline earth metal salt, or combinations of two or more thereof.

6. A composition according to claim 1 wherein said basic thickener is ammonium carbonate, ammonium bicarbonate, ammonium phosphate, ammonium carboxylate, alkali metal carbonate, alkali metal bicarbonate, alkali metal phosphate, alkaline earth metal carbonate, alkaline earth metal bicarbonate, alkaline earth metal phosphate, or combinations of two or more thereof.

7. A composition according to claim 2 wherein said basic thickener is ammonium carbonate, ammonium bicarbonate, ammonium phosphate, ammonium carboxylate, alkali metal carbonate, alkali metal bicarbonate, alkali metal phosphate, alkaline earth metal carbonate, alkaline earth metal bicarbonate, alkaline earth metal phosphate, or combinations of two or more thereof.

8. A composition according to claim 1 wherein said basic thickener is sodium carbonate, trisodium phosphate, potassium carbonate, tripotassium phosphate, or combinations of two or more thereof.

9. A composition according to claim 2 wherein said basic thickener is sodium carbonate, trisodium phosphate, potassium carbonate, tripotassium phosphate, or combinations of two or more thereof.

10. A composition according to claim 3 wherein said basic thickener is sodium carbonate, trisodium phosphate, potassium carbonate, tripotassium phosphate, or combinations of two or more thereof.

11. A composition according to claim 1 wherein said additional thickener is polytetrafluoroethylene, talc, silica, clay, boron nitride, metal soaps, titanium dioxide, polydimethylsiloxane, polyurea, polyurethane, or combinations of two or more thereof.

12. A composition according to claim 6 wherein said additional thickener is polytetrafluoroethylene, talc, silica, clay, boron nitride, metal soaps, titanium dioxide, polydimethylsiloxane, polyurea, polyurethane, or combinations of two or more thereof.

13. A composition according to claim 10 wherein said additional thickener is polytetrafluoroethylene, talc, silica, clay, boron nitride, metal soaps, titanium dioxide, polydimethylsiloxane, polyurea, polyurethane, or combinations of two or more thereof.

14. A composition comprising or produced by combining a halogenated oil, a basic thickener, and optionally an additional thickener wherein said halogenated oil is a perfluoropolyether, a fluorosilicone, or combinations thereof;

said basic thickener is an ammonium salt; a metal salt which is a metal carbonate, a metal bicarbonate, a metal phosphate, or a metal nitrite; metal hydroxide; or combinations of two or more thereof;

said additional thickener is polytetrafluoroethylene, talc, silica, clay, boron nitride, metal soaps, titanium dioxide, polydimethylsiloxane, polyurea, polyurethane, or combinations of two or more thereof.

15. A composition according to claim 14 wherein said halogenated oil is said perfluoropolyether and is $CF_3—(CF_2)_2—O—[CF(CF_3)—CF_2—O]_s—R_f$, $CF_3O[CF_2CF(CF_3)—O—]_m(CF_2—O—)_n—R^1_f$, $F—[(CF_2)_3—O]_t—R^2_f$, $CF_3O(CF_2CF_2—O—)_p(CF_2—O)_qCF_3$, $CF_3O[CF_2CF(CF_3)O]_m(CF_2CF_2O)_o(CF_2O)_n—R^1_f$, or combinations of two or more thereof; s is 2–100, inclusive; $R_f$ is $CF_2CF_3$, a $C_3$ to C6 perfluoroalkyl group, or combinations thereof; $R^1_f$ is $CF_3$, $C_2F_5$, $C_3F_7$, or combinations of or two or more thereof; (m+n) is 8–45, inclusive; o is >1; (m+n+o) is 8–45, inclusive; m/n is 20–1000, inclusive; $R^2_f$ is $CF_3$, $C_2F_5$, or combinations thereof; t is 2–200, inclusive; (p+q) is 40–180, inclusive; and p/q is 0.5–2, inclusive; and said basic thickener is ammonium carbonate, ammonium bicarbonate, ammonium phosphate, ammonium carboxylate, alkali metal carbonate, alkali metal bicarbonate, alkali metal phosphate, alkaline earth metal carbonate, alkaline earth metal bicarbonate, alkaline earth metal phosphate, or combinations of two or more thereof.

16. A composition according to claim 15 wherein said halogenated oil is $CF_3—(CF_2)_2—O—[CF(CF_3)—CF_2—O)_s—R_f$ and said basic thickener is sodium carbonate, sodium triphosphate, potassium carbonate, potassium triphosphate, or combinations of two or more thereof.

17. A composition comprising or produced by combining a perfluoropolyether, a basic thickener, and optionally an additional thickener wherein said perfluoropolyether is $CF_3—(CF_2)_2—O—[CF(CF_3)—CF_2—O]_s—R_f$;

said basic thickener is sodium carbonate, sodium triphosphate, potassium carbonate, potassium triphosphate, or combinations of two or more thereof; and said additional thickener is polytetrafluoroethylene, talc, silica, clay, boron nitride, metal soaps, titanium dioxide, polydimethylsiloxane, polyurea, polyurethane, or combinations of two or more thereof.

18. A spark plug having applied thereto a composition as recited in any one of claims 1 to 17.

* * * * *